United States Patent [19]

Lawson

[11] Patent Number: 5,076,465

[45] Date of Patent: Dec. 31, 1991

[54] REFILLABLE POCKET TISSUE HOLDER

[76] Inventor: Roderick A. Lawson, 906 Greeley St., Stillwater, Minn. 55082

[21] Appl. No.: 393,297

[22] Filed: Aug. 14, 1989

[51] Int. Cl.[5] ..... B65H 1/00

[52] U.S. Cl. ..... 221/47; 221/56; 221/58; 221/61; 221/63; 221/305

[58] Field of Search ..... 221/33, 47, 49, 51, 221/55, 58, 61, 62, 63, 185, 197, 281, 303, 305, 306, 312 R, 312 C; 206/38, 555, 556, 449, 233, 37, 39.7; 229/122, 123.1, 124, 125.37, 125.39, 131.1, 132, 75

[56] References Cited

U.S. PATENT DOCUMENTS

| | | | |
|---|---|---|---|
| 1,662,980 | 3/1928 | Palmer | 221/33 X |
| 2,195,622 | 4/1940 | Fourness et al. | 221/51 X |
| 2,256,638 | 9/1941 | Blakeney | 221/305 X |
| 2,316,796 | 4/1943 | Lichter | 221/63 |
| 2,475,657 | 7/1949 | Braley | 221/61 |
| 2,501,357 | 3/1950 | Speckman et al. | 221/58 |
| 2,768,739 | 10/1956 | Gongolas | 221/47 X |
| 3,395,830 | 8/1968 | Buttery | 221/63 |
| 4,175,673 | 11/1979 | McDonald et al. | 221/63 |

FOREIGN PATENT DOCUMENTS

| | | | |
|---|---|---|---|
| 467112 | 8/1950 | Canada | 221/49 |

*Primary Examiner*—David H. Bollinger
*Attorney, Agent, or Firm*—Schroeder & Siegfried

[57] ABSTRACT

A pocket dispenser of facial tissues comprising a container which is readily openable for replenishing the supply of facial tissues therewithin and having an opening adjacent to which one end of a layer of separate facial tissues is disposed for ready withdrawal of separate tissues through the opening, the layer of separate tissues being consecutively oppositely folded longitudinally at least twice, one of the reverse folds being disposed adjacent the bottom of the container and the tissue disposed most closely to the opening being the inside tissue within the latter fold whereby same may be readily removed from the layer. Expandable positioning panels are disposed within the folds for aiding in maintaining the layer of tissues in position and properly oriented.

45 Claims, 5 Drawing Sheets

REFILLABLE POCKET TISSUE HOLDER

BACKGROUND OF THE INVENTION

Facial tissues are in common use by the public, particularly by persons suffering from the common cold, who have frequent need for same. As a result, various manufacturers have marketed pocket-sized packets of such tissues for the convenience of the user. Such packets, however, quickly lose their shape and, as a consequence, the tissues remaining therein quickly ball up and become unsightly and difficult to carry and use. Also, it is frequently difficult to remove a single tissue, with the undesirable result of two or more tissues being removed at the same time. Moreover, there is much waste and the separate packaging of relatively small supplies of tissue makes the latter costly. Thus, there has long been a standing need for a more effective and satisfactory dispenser which, in addition to obviating the above inadequacies, will be refillable by the user and therefor much less costly. My new pocket dispenser of facial tissues accomplishes each of these purposes.

BRIEF SUMMARY OF THE INVENTION

My invention includes the provision of a small flat container constructed and designed to enable a user to select from a relatively large supply box, a layer of superimposed separate facial tissues, to fold them properly, and to insert them into the pocket container which will protect the tissues, facilitate their separate removal therefrom as needed, and carry them in the pocket, purse, car seat, car "caddy", etc., for relatively long periods of time without damage thereto or disarrangement.

To accomplish the above I provide a pocket container either in flat pattern form from which the container can be readily and easily formed or in previously assembled form, as the user or manufacturer may choose. I believe the preferred form of container would be one in previously assembled form, with a closure flap for easy access to its interior. In either case, initially a plurality of separate facial tissues, each superimposed one upon the other, are selected in layer form, as received in the domestic supply type of box already on the market. Such a layer is then reversely folded longitudinally along one transverse line. Thereafter it is again reversely folded longitudinally in the opposite direction. Preferably it is reversely folded longitudinally, consecutively in opposite directions, a total of three times so as to divide the tissues into quarter sections, although as few as two longitudinal reverse folds may be utilized, provided they are in opposite directions. It is preferable that the open or break side of the tissues face outwardly in order to facilitate initial engagement thereof by the user.

It is important, however, that when the tissues are inserted into the container, an end fold of the layer of tissues be located adjacent an opening which is provided in the container. That opening may be in one or both of the sidewalls of the container or in the closure flap thereof. It is also important that one of the reverse folds be disposed adjacent the bottom of the container and remote from the said opening, and that the tissue closest to said opening is the inside tissue of said reverse fold which is remote from said opening. When the tissues are so folded and so disposed within such a container, the separate tissues may be readily and easily removed from the container.

To ensure that such a container filled with such folded tissues may be carried within the user's pocket for long periods of time without becoming misshapen, unsightly and difficult to remove for use, I utilize expanded positioning panels within some of the respective folds of the layer of tissue. These positioning panels are relatively rigid as compared to the various portions of the container and tend to expand in a transverse direction slightly so as to hold the tissues in place within the container and to preclude their becoming misshapen, unsightly and difficult to utilize. In addition, they preferably extend longitudinally slightly beyond the associated fold and are slightly narrower than the layer at the crease of the fold. Such a positioning panel is not utilized in the fold disposed at the bottom of the container since it would obviously preclude withdrawal of the inner layer. The positioning panels are preferably connected at their lower edges and urged outwardly either by a U-shaped connector or by thicker material being used, from which the panels are fashioned, at the area where they are joined.

The opening through which the individual tissues are withdrawn from the layer of tissues is preferably centrally located with respect to the end walls of the container. Thus, portions of the container defining said opening adjacent the end walls cover the more lateral portions of the layer of tissues and hold them in proper position within the container as a tissue is being withdrawn and while the container is being carried within the user's pocket.

The invention includes the provision of a pattern for forming such a container as described in order to enable the user to readily open the same, replenish the stock of folded tissues, and then re-form the container by closing same as designed. In this regard, I provide a flexible pattern having a generally rectangular sidewall portion which has four flaps extending outwardly therefrom, namely two opposed end flaps and a top and bottom flap, each of which extend in opposite directions at substantially right angles to the end flaps. A dispensing opening is provided in either the sidewall portion or the top or closing flap, or in both, if desired. The two end flaps have means for securing the two together when they are folded over the folded layer of tissue with one end of the layer adjacent or opposite to the opening. The bottom and closing flaps also have means for securing the same to each other when folded inwardly over the end flaps to complete the formation of a container for the folded layer and positioning panels. Preferably, the container is performed to have side and end walls, with only a closure flap at the top or bottom, to facilitate replenishing of the supply of tissues. The same result may be obtained by permanently securing the end flaps to each other and to either the top or bottom flap.

When the layer needs to be replenished, the bottom and closing flaps are opened, followed by opening the end flaps to thereby gain access to the interior of the container for replenishment of the supply of tissues. Of course, if a performed container is used, only the closure flap need be opened to gain access to the interior of the tissue panels. In this manner, I have provided a novel and highly improved pocket facial tissue dispenser which maintains the tissues in their initial good shape despite prolonged carry thereof in the user's pocket and which enables the user to readily and easily replenish the supply of tissues as needed.

BRIEF DESCRIPTION OF THE DRAWINGS

These and other objects and advantages of the invention will more fully appear from the following description, made in connection with the accompanying drawings, wherein like reference characters refer to the same or similar parts throughout the several views, and in which.

DETAILED DESCRIPTION OF THE INVENTION

Figure 1:
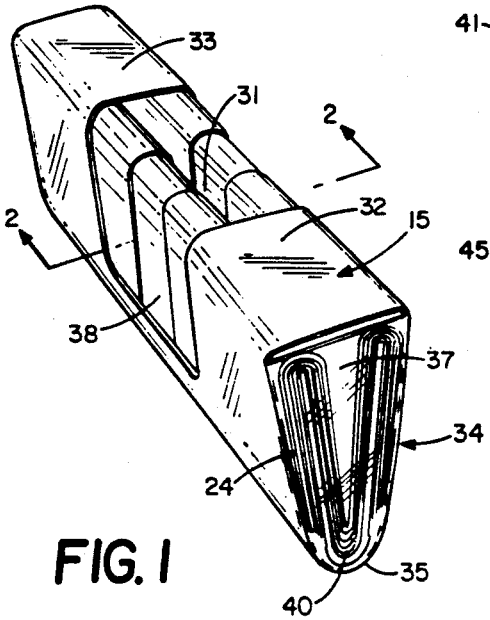
FIG. 1 is a perspective view of the preferred form of my invention, with the opening extending over the top from both sides, and with the tissues therewithin.
Figure 4:
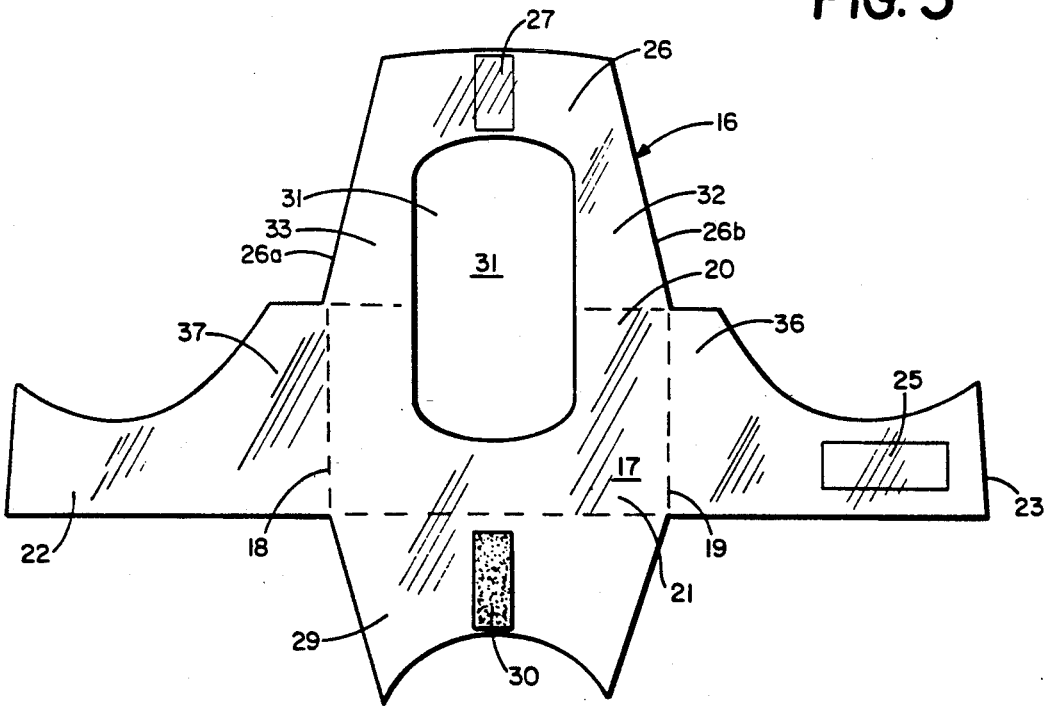
FIG. 4 is a plan view of the pattern for the container shown in FIG. 1.

FIG. 1 shows a perspective view of one assembled embodiment of my invention. FIG. 4 shows a plan view of a pattern for the container 15 of FIG. 1. As shown, the pattern is comprised of a generally rectangular panel 16 of flexible material having a generally rectangular sidewall portion 17 (as outlined by the broken lines) which has a pair of opposite ends 18, 19 and opposite top area 20 and bottom area 21.

As shown, a pair of end flaps 22, 23 are disposed at the opposite ends of the sidewall portion 17, one end of which extends outwardly from one of said ends. These end flaps are constructed and arranged to fold inwardly, one over the other, in overlapping relation over a layer 24 of reversely folded, consecutively in opposite directions, separate facial tissues, when such a layer is disposed upon said rectangular sidewall portion 17.

Means 25 is provided for securing the end flaps 22, 23 to each other in such overlapping relation and in retaining relation to said layer 24 of facial tissues. Such means may be a pair of Velcro elements one each of which is secured to one of the end flaps so as to engage each other when so folded, or a strip of tape 25, such as is produced by Minnesota Mining Company, of St. Paul, Minn., which has a tacky material on both sides of the strip, known as Hi-Tac, Lo-Tac tape. Such a strip of tape may be carried by any surface of one of the flaps which engages a surface of the other flap, when so folded.

A top flap 26 is carried by the top area 20 and extends outwardly therefrom. It is constructed and arranged to be swung outwardly and downwardly around and over such a reversely folded layer 24 of facial tissues to retain such a folded layer within the container 15 which has been so constructed as described herein and which is formed by securing the top flap to the exterior of the folded and interengaged end flaps by securing means 27. This securing means 27 may be of the same type as securing means 25. It will be seen that when the top flap is so secured, an opening 28 is defined adjacent the bottom area 21 within which the folded layer 24 of facial tissue is positioned, as shown in FIG. 1.

A closure flap portion 29 is carried by the side wall portion 17 at its bottom area 21 and serves to close the container when it is swung outwardly and upwardly in overlapping relation to the folded layer 24, and secured by its securing means 30 to the exterior surface of top flap 26. Securing means 30 is utilized to secure the closure flap 29 in snug cooperative enveloping relation with end flaps 22, 23 and top flap 26, relative to folded layer 24, as shown in FIG. 1. Such securing means 30 may be any suitable securing means as, for example, of the type described herein with respect to securing means 25. When so secured, the container 15 in closed condition is so formed, except that an opening, such as will be hereinafter described, remains to be provided for access from the exterior to the folded layer 24 which has been so enveloped.

In the shown form of the container 15, an opening 1 is formed in the top flap portion 26 and sidewall portion 17, in order to provide access from the exterior to the reverse folded layer 24 which is positioned within the interior of the container 15. As shown, the opening 31 preferably extends over the top of the container and downwardly into the sidewall portion 17, thereby providing ready access to the interior from either side or the top of the container to layer 24. The opening 31 is centrally located between the side edges 26*a*, 26*b* of the top flap portion 26 and is positioned somewhat inwardly thereof so as to leave relatively wide retaining strips 32, 33 extending across the top of the layer 24 to adequately retain the same within the container 15 when an individual tissue is withdrawn from layer 24.

It will be seen that the two end flaps 22, 23 when folded in overlapping relation, together with the top flap 26 and the closure flap 29, when the latter is closed, form a sidewall of container 15 which is opposite the sidewall portion 17. Similarly, the upward folding of bottom flap 29 forms a bottom wall 35 and the inward folding of the end flaps 22, 23 form container end walls 6, 37, while the top flap 26 constitutes a top wall.

Figure 2:
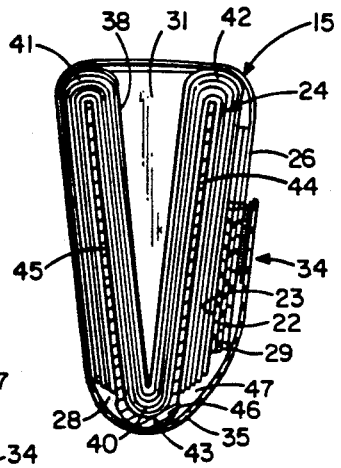
FIG. 2 is a vertical sectional view taken along line 2—2 of FIG. 1.

As best shown in FIG. 2, the tissue layer 24 is comprised of a plurality, preferably 15-25, of separate panels of facial tissues. Each of these separate tissues has a break side which is characterized by the side edges of the tissue being folded inwardly toward each other but not meeting, so as to leave a "break" or space thereinbetween. The separate panels are not interengaged, as are some tissues on the market, which cause each tissue, as it is withdrawn from a container such as a box, to draw the end of the adjacent tissue outwardly of the box, to thereby facilitate its subsequent withdrawal. Instead, each panel is disconnected and separate relative to its adjacent panel.

As shown in FIG. 2, in the depicted embodiment, the tissue layer 24 is reversed upon itself longitudinally and consecutively in opposite directions three times. As a consequence, the layer is divided into four approximately equal sections and the panel 38, which is closest to the opening 31, is the inside panel of the middle fold, which permits that panel to be removed relatively easily. It will be noted that the middle fold 40 is disposed most adjacent the bottom wall 35, while the two reverse folds 41, 42 which are adjacent the ends of the panels are disposed more remotely from the bottom wall 35 and more closely to the opening 31. It will also be seen that the ends of the individual panels are adjacent the opening 31.

FIG. 2 also shows expander means 43 disposed within the two end folds 41, 42. This expander means 43 includes a pair of positioning panels 44, 45 which are relatively rigid as compared to the various portions of the container, one each of which is positioned within one of the end folds, as shown. Each of the positioning panels is connected to the other at its lower edge, which is close to the bottom wall 34, by a U shaped stiffener or channel member 46, the legs of which extend outwardly away from each other so as to support the two positioning panels in diverging relation and urging them away from each other. If desired, the two panels 44, 45 may be made from a single blank with strengthening material added adjacent the line at which it is folded to provide the same outward urging of the positioning panels 44, 45.

Each of the positioning panels 44, 45 at its free end is of approximately the same width as that of folded layer 24 and it increases in width toward the line of juncture of the two panels so as to extend laterally outwardly beyond the layer 24 adjacent bottom wall 35. It will be seen that the ends of the tissue panels are adjacent the line of juncture of the two panels 44, 45.

If desired each of the positioning panels may be textured or one of a pair of rubberized or otherwise textured elongated strips (not shown) may be secured to the exterior of each of the panels 44, 45 to provide a slight retaining drag upon the layer so as to preclude more than one panel being removed when a single tissue panel is withdrawn.

To utilize my invention, one selects 15–20 separate panels of facial tissues and folds them longitudinally in consecutive reverse folds which, as shown in FIG. 2, provides layer 24. The positioning panels 44, 45 are then inserted within the two end folds 41, 42, as shown, and this assembly is placed centrally upon the sidewall portion 17 with the middle fold 40 and channel member 46 extending along closure flap 29. The end flaps 22, 23 are then folded inwardly into overlapping relation and secured to each other around the tissue assembly. The top flap 26 is then folded downwardly over the end flaps and secured thereto. This defines an opening 47 for the container 15 through which additional tissue panels may be supplied, as needed. The closure flap 29 is then folded upwardly over the top flap 26 and secured thereto to completely encase the tissue layer 24, as shown, to complete the tissue dispenser container.

Then a tissue is desired, the user merely engages the tissue 38 closet to opening 31 and draws outwardly, whereupon the tissue will come free easily, since it is the inside tissue of the middle fold 40. I find that the dispenser functions most efficiently if the container is grasped in one hand with the thumb and middle finger thereof pressing inwardly upon opposite end of the channel member 46 as the tissue is being withdrawn. The positioning panels 44, 45 aid in maintaining the remaining tissues of layer 24 in proper position within the container as a single tissue is withdrawn, and also while the container and layer 24 are being carried about in the user's pocket.

Figure 3:
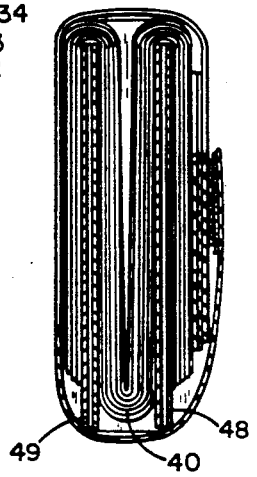
FIG. 3 is a vertical sectional view of a second form of my invention with the tissues folded similarly to those of FIG. 1.

FIG. 3 is a vertical sectional view of a container 15, such as is shown in FIG. 2, with the layer 24 of facial tissues reversely folded longitudinally in the same manner, but with separate positioning panels 48, 49. These two panels are relatively rigid, generally rectangular in shape, are of approximately the same width as layer 24 at their tops, and are slightly wider than that layer at their lower ends which are adjacent the reverse fold 40, so as to extend slightly therebeyond at each end.

The panels of layer 24 in FIG. 3 are exposed in the same manner as those in FIGS. 1–2 and they are removed singly in the same manner.

When the supply of panels which make up the layer 24 becomes substantially diminished, it is an easy matter to replenish same. The user merely opens the container by freeing the retaining means 30, 27, and 25, in that order by spreading the walls of the container out as shown in FIG. 4. An additional supply of separate facial tissues may then be added to layer 24 and the latter may then be again reversely folded as shown in FIG. 1–3 and placed upon wall portion 17. The end flaps 22, 23, top flap 26, and closure flap 29 may then be closed over layer 24 as hereinbefore described, and the resultant packet is then again ready for use and for carrying in the user's pocket.

Figure 5:
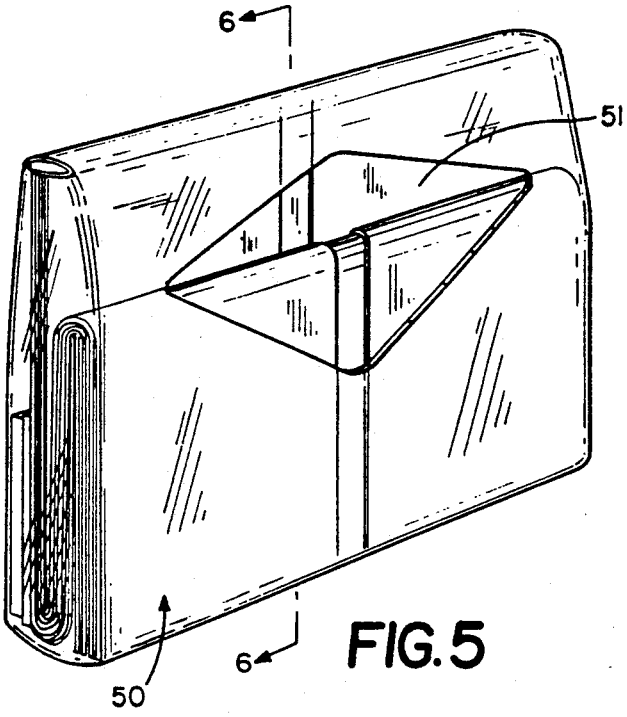
FIG. 5 is a perspective view of a third form of my invention with an access opening in the sidewall portion only.
Figure 6:
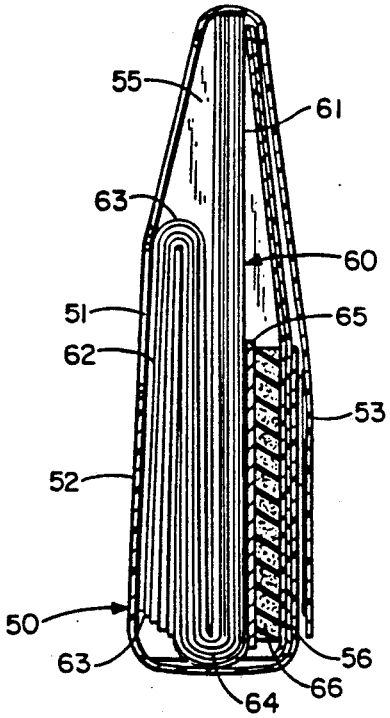
FIG. 6 is a vertical sectional view taken along line 6—6 of FIG. 5.
Figure 7:
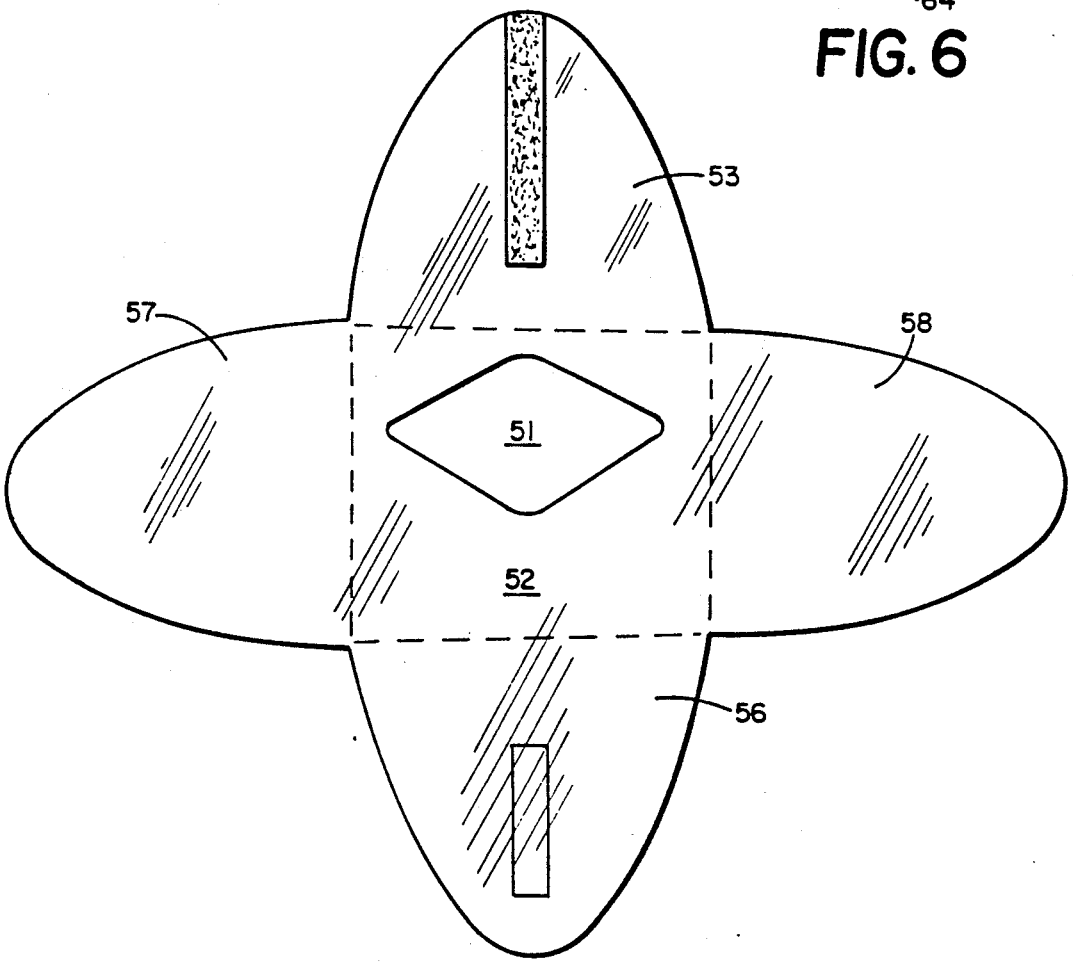
FIG. 7 is a plan view of a pattern for the container shown in FIG. 5.
Figure 8:
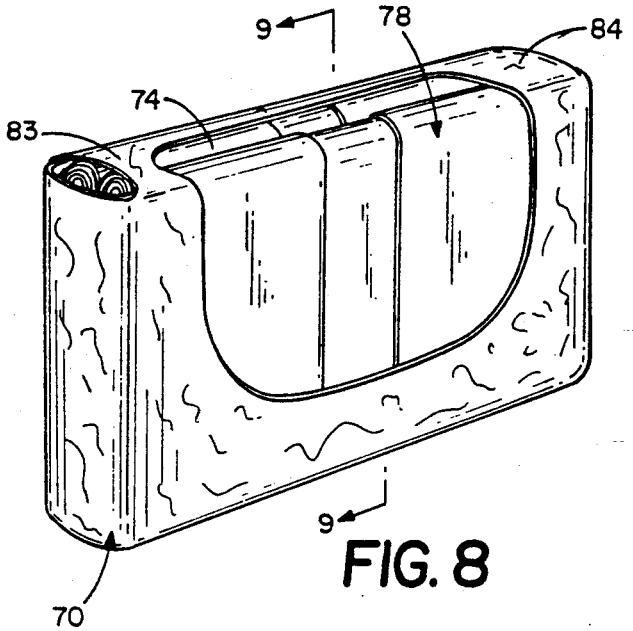
FIG. 8 is a perspective view of a fourth form of my invention, showing an oval access opening in the sidewall and top portion of the container.
Figure 9:
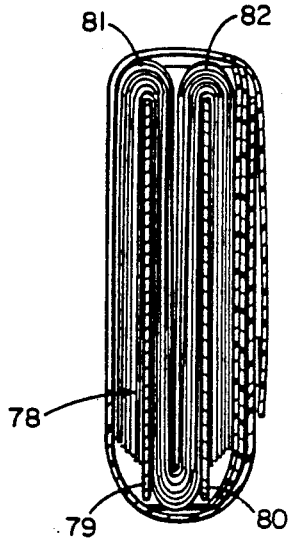
FIG. 9 is a vertical sectional view taken along line 9—9 of FIG. 8.

FIG. 5 shown another form of my invention in which the opening 5 of container 50 is triangularly shaped and is disposed centrally within the sidewall 52. The closure flap 53 extends over the top of the container 50 as shown in FIG. 6 to close opening 55 thereof, and is secured to bottom flap 56. End flaps 57 and 58 extend in overlapping relation and are secured to each other by any suitable means (not shown), as hereinbefore described.

The panel layer 60, however, if formed differently from panel layer 24. As shown, it is reversed longitudinally upon itself consecutively in opposite directions only twice, with one free end portion 61 must longer then the other 62. The layer 60 is positioned opposite opening 51 so that the outside panel 63, readily accessible through the opening 51, is the inside layer of the fold 64 adjacent the bottom of the container and most remote relative to opening 51. A generally rectangular positioning panel 65, slightly wider at its lower edge than the fold 64, provides adequate support for the two folds and a foam rubber panel 66 of dimensions similar to those of panel 65 is secured to the outer surface thereof and urges the folded layer 60 against sidewall 52 so as to maintain the folds of the layer in proper position, as separate tissue panels are withdrawn.

Figure 10:
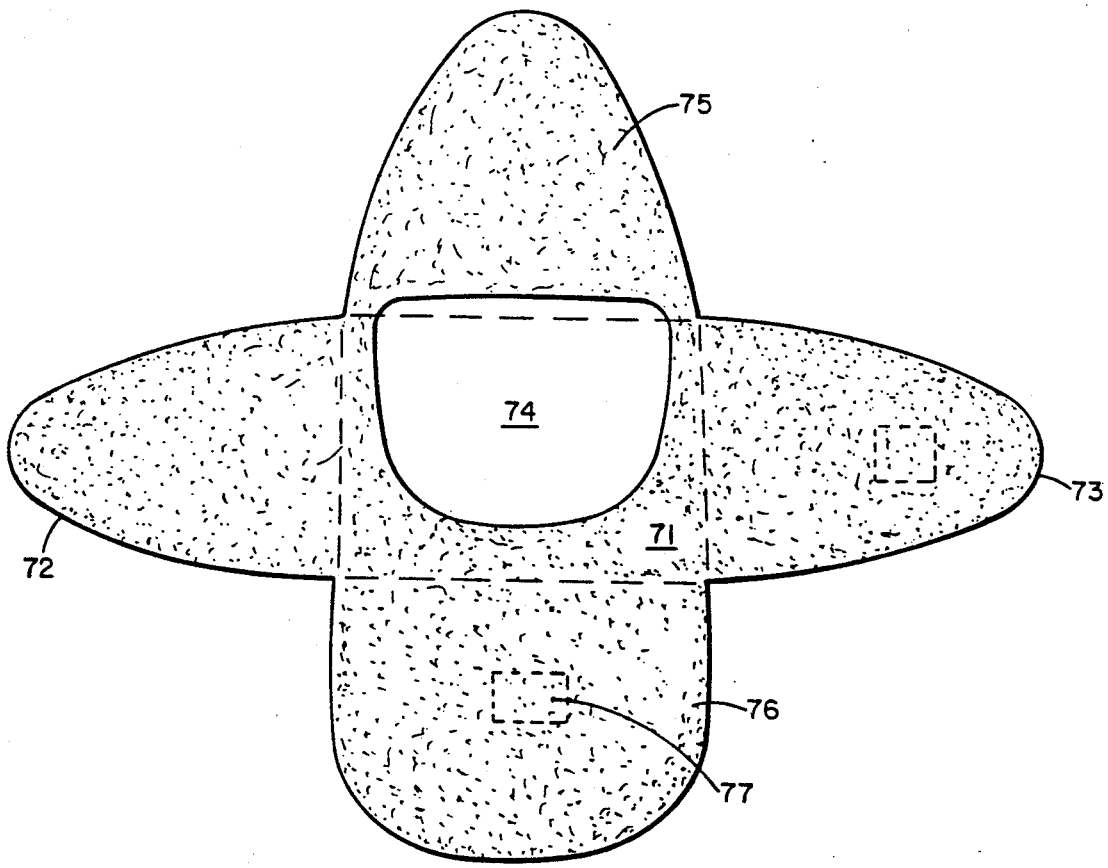
FIG. 10 is a plan view of a pattern for the container shown in FIG. 8.

FIG. 10 shown a pattern for another form of container 70. This pattern has a sidewall portion 71 from which end flaps 72, 73 extend and in which a central opening 74 is formed and extends into closure flap 75. The latter folds over the top and is secured to bottom flap 76 via securing means 77. Layer 78 of separate tissue panels is reversely folded similarly to layer 24 as shown in FIG. 1–2, and is supported by positioning panels 79, 80 which are constructed and positioned in the same manner and relationship to the folds 81, 82 as are positioning panels 48, 49 to the folds in FIG. 3. It will be noted that opening 74 extends over the top of the two end folds 81, 82 and that it is centrally disposed, with relatively wide bands 83, 84 of closure flap 75 extending over the ends of said folds.

Figure 11:
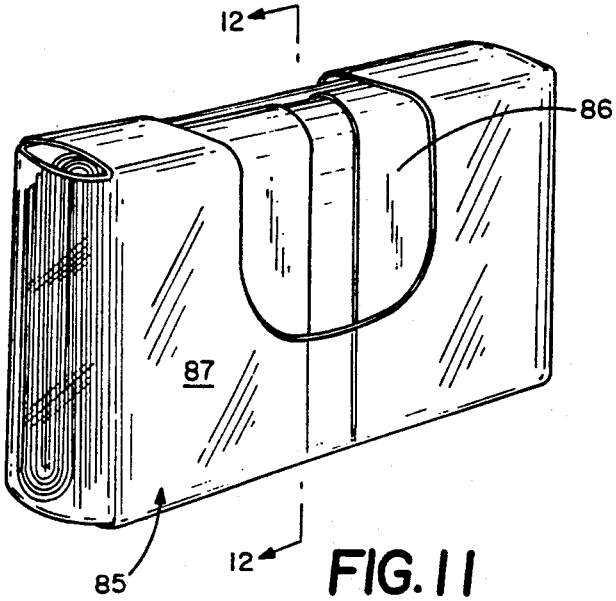
FIG. 11 is a perspective view of a fifth form of my invention.
Figure 12:
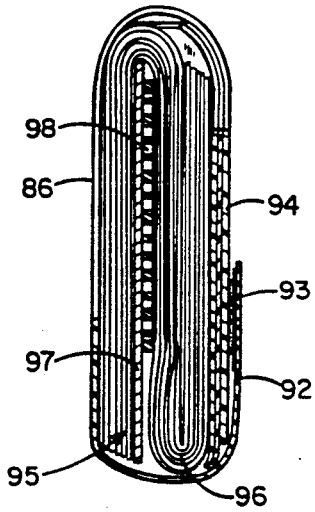
FIG. 12 is a vertical sectional view taken along line 12—12 of FIG. 11.
Figure 13:
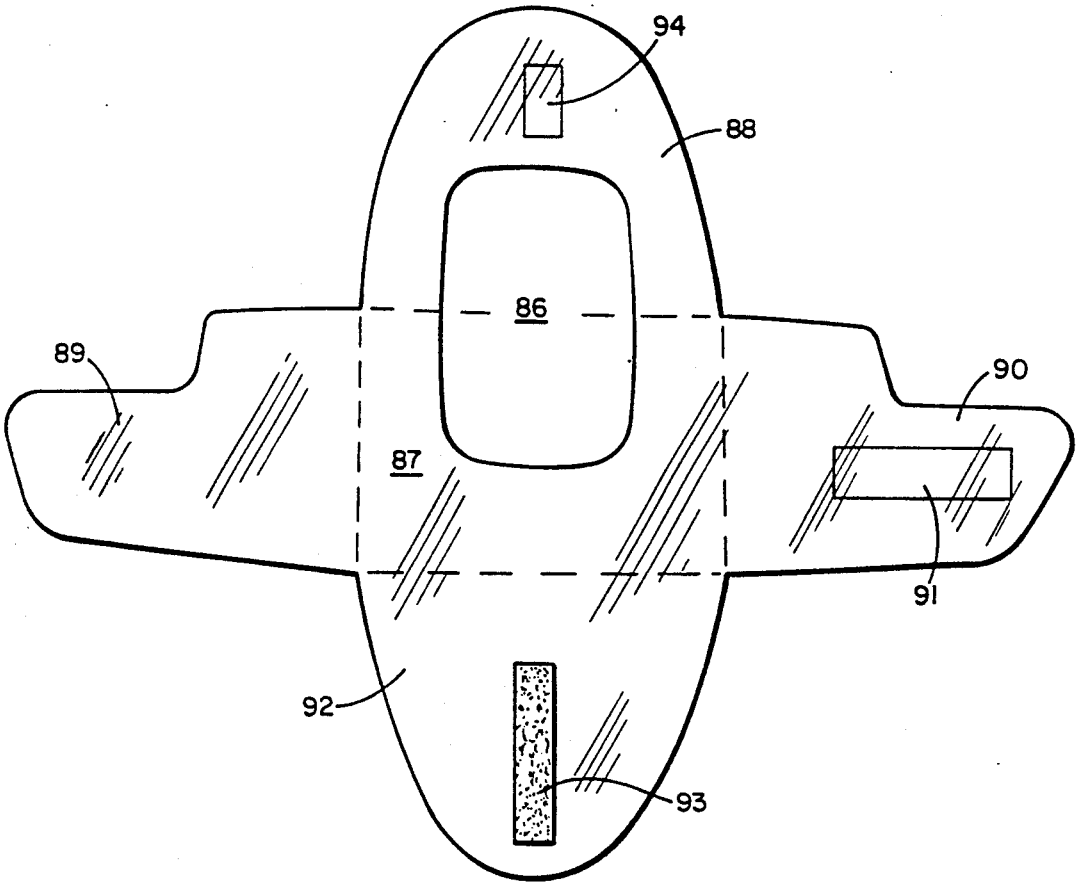
FIG. 13 is a plan view of a pattern for the container shown in FIG. 11.

FIG. 13 shows a pattern for another container 85 in which opening 86 is oval-shaped and centrally disposed within rectangular side wall portion 87 and flap 88. As shown, it has end flaps 89, 90 with securing means 91. Bottom closure flap 92 carries securing means 93 and flap 88 carries securing means 94. End flaps 89, 90 are swung into overlapping relation over reversely folded tissue layer 95, then top flap 88 is folded thereover and secured thereto, and then bottom flap 92 is swung to closed position as shown in FIG. 12. As shown in FIG. 11, the break side of the tissue panels face outwardly, providing ready and easy access individually to the panels or sheets.

It will be seen by reference to FIG. 12 that layer 95 is reversely folded consecutively only twice and that the outside tissue panel accessible through opening 86 is the inside panel in the fold 96 disposed remotely relative to said opening, at the bottom of the container. It will also be seen that I have provided a positioning panel 97 of shape and dimensions relative to the layer 95 similar to that hereinbefore described. If desired, one side of panel 97 may be textured or, in lieu thereof, that side may carry, as shown, a rubberized strip 98 extending the length of panel 97 and anchoring the remainder of the layer 95, as a single panel is withdrawn therefrom through opening 86.

Figure 14:
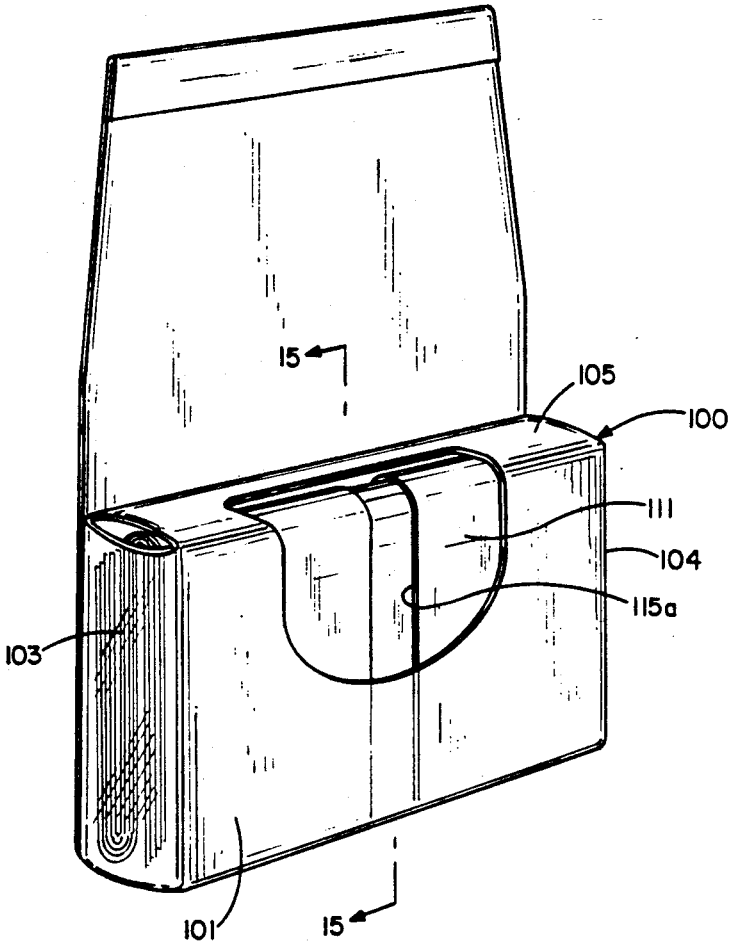
FIG. 14 is a perspective view of the preferred form of my invention.
Figure 15:
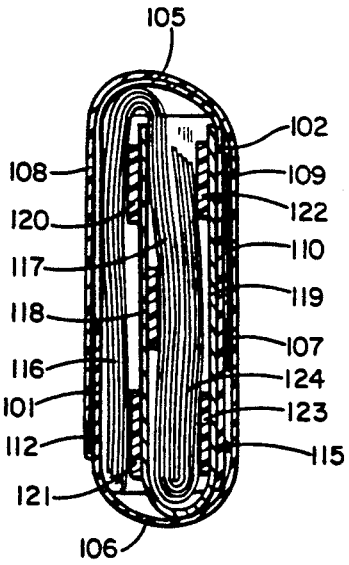
FIG. 15 is a vertical sectional view taken along line 15—15 of FIG. 14.

The preferred form of my invention is shown in FIGS. 14–15. As shown, it consists of a generally rectangular container 100 which has sidewalls 101, 102, end walls 103 and 104 (not shown), a top wall 105 and a bottom wall 106. One edge of the bottom wall 106 is connected to a closure panel 107, an extension of which constitutes a cover member 108. As shown, the bottom of the container 100 is open, when the closure member is open, to permit a layer of tissue panels folded as hereinbefore described to be inserted within the container from the bottom.

As shown, sidewall 102 carries a strip 109 of Velcro which cooperates with a strip of Velcro 110 that is carried by the closure panel 107. When the latter is swung to closing position, as shown in FIG. 15, bottom wall 106, which is a part of closure panel 107, also moves into closing position relative to the bottom opening of the container.

Opposite sidewall 101 has an opening 111 formed centrally thereof in substantially spaced relation to end walls 103 and 104. As shown, this opening is disposed in the upper portion of said end wall and may, as shown, extend into the top wall 105. When container 100 is carried in the user's pocket, cover 108 is disposed in overlapping relation to opening 111 so as to cover the tissues within container 100, as shown in FIG. 15. Cover 108 is secured in covering position by a strip 112 of double acting adhesive tape.

The layer 115 of tissues may be folded longitudinally about either two transverse lines, as shown, or about three such lines. The individual tissues are superimposed with respect to each other in non-interengaging relation. The folds, as hereinbefore described, are reversed in direction consecutively. One end fold 116 is disposed adjacent the opening 111 and the fold 117 adjacent thereto is disposed remotely relative to said opening. The "break" side of the tissues face outwardly at the opening 111 so as to facilitate extraction. The outermost tissue panel 115*a* at the opening 111 is the innermost tissue at the fold 117, to facilitate extraction without disturbing the remainder of the tissues.

Extending upwardly from the bottom of the container 100 and between the folded portions of the layer 115 is a pair of positioning panels 118, 119 which are semi-rigid or rigid and are narrower than the folded portions of the layer 115. As shown, panel 118 carries a pair of strips 120, 121 of spaced retainer strips made of foam rubber or foamed polyester material. These strips extend across the width of the positioning panel between the first and second fold portions 116, 117 of layer 115.

The opposite positioning panel 119 carries a similar pair of retainer strips 122, 123 which bear against the innermost tissue as it extends along the outer surface of the third fold portion 124. These retainer strips perform the same function as strips 120, 121.

When the layer of tissues is folded three times, so as to divide the layer into four portions, the positioning panel 119 will extend upwardly between the third and fourth portions of the tissue layer 115.

Although each of the forms of my invention operate satisfactorily, the preferred form described immediately hereinabove appears to require less care in the withdrawal of the individual tissues and thus is probably the most acceptable and desirable form to the public. Also, this form appears to protect the tissues and functions most acceptably over a period of time since the cover member maintains the tissues in a clean and unrumpled and unworn condition.

I have found that each of the above forms of my invention constitutes a substantial improvement over pocket tissue packets as heretofore known. An adequate supply of facial tissues may be carried in one of the above containers, in the user's pocket, over an extended period without becoming rumpled, balled or in otherwise unsatisfactory condition for use. When the supply of tissues becomes diminished substantially, it is an easy matter to merely open the container, unfold the remaining supply of tissues, supplement that supply with additional tissues, re-fold the supplemented layer of tissues reversely as before, re-insert the folded layer within the container and close the closure flap thereof, whereupon the container again becomes a superior dispenser of tissues which may be carried about in the user's pocket.

It will, of course, be understood that various changes may be made in the form, details, arrangement and proportions of the parts without departing from the scope of the invention which consists of the matter shown and described herein and set forth in the appended claims.

What is claimed is:

1. A flexible pocket facial tissue dispenser which may be diminished in size as tissues are dispensed therefrom in order to maintain the tissues remaining therewithin in proper alignment comprising:

(a) a generally rectangular flexible container having a pair of opposed flexible end wall members, a pair of opposed flexible sidewall members, a flexible top wall member and a flexible bottom wall member;

(b) said container having an opening therein for the introduction of a layer of separate facial tissues superimposed on upon the other;

(c) a flexible closure member supported by one of said wall members for cooperatively closing said container opening and thereby enclosing such tissues therewithin;

(d) means for adjustably and releasably securing said flexible closure member in increasingly tightening closing relation to the interior of said container to thereby enable the user to progressively decrease the size of the interior of said container as the tissues are dispensed therefrom;

(e) one of said wall members having a centrally disposed opening extending therethrough bringing the exterior into communication with the interior of said container therethrough;

(f) a layer of a plurality of separate tissue panels superimposed one upon another, said layer being disposed within said container and being reversely folded at least twice longitudinally upon itself into consecutively oppositely directed reverse folds at least one of which constitutes an end fold;

(g) said end fold being disposed adjacent said centrally disposed opening, thereby providing readily access to said tissue panels from the exterior;

(h) one of said reverse folds being disposed remotely relative to said centrally disposed opening; and (i) the tissue panel the end portion o which is closest to said centrally disposed opening being the inside tissue of said remotely disposed reverse fold whereby said tissue panel the end of which is closest to said centrally disposed opening may be readily removed from said layer and said container without substantially disturbing the position of the remaining tissue panels within said container.

2. The structure defined in claim 1, wherein said centrally disposed opening is in one of said sidewall members.

3. The structure defined in claim 1, wherein said centrally disposed opening is in said closure member.

4. The structure defined in claim 1, wherein said centrally disposed opening is spaced inwardly a substantial distance from the ends of said one cooperating wall member.

5. The structure defined in claim 1, wherein a substantial area of said cooperating wall member in which said centrally disposed opening is formed, remains between said centrally disposed opening and each of said end walls, whereby the remaining panel tissues are held in place thereby within the dispenser as the tissue panel, the end of which is closest to said centrally disposed opening, is withdrawn.

6. The structure defined in claim 1, wherein the number of said reverse folds is two.

7. The structure defined in claim 1, wherein the number of said reverse folds is three.

8. The structure defined in claim 1, wherein said centrally disposed opening extends into said top wall member and at least one of said sidewall member.

9. The structure defined in claim 1, wherein said centrally disposed opening is generally triangular in shape.

10. The structure defined in claim 1, wherein said centrally disposed opening extends into each of said opposed sidewalls.

11. The structure defined in claim 1, wherein said centrally disposed opening is generally oval in shape.

12. The structure defined in claim 1, and a relatively rigid positioning panel disposed within the fold of at least one of said reverse folds of said layer.

13. The structure defined in claim 1, and a relatively rigid positioning panel disposed within the fold of each of at least two of said reverse folds.

14. The structure defined in claim 1, wherein said layer has a reverse fold adjacent each of its ends, and a pair of relatively rigid positioning panels one each of which is disposed within one of said reverse folds adjacent each end of said layer.

15. The structure defined in claim 1, and a relatively rigid positioning panel disposed within the fold of at least one of said reverse folds of said layer, said positioning layer having slightly greater dimensions taken longitudinally of said layer than the corresponding longitudinal dimensions of said reverse fold in which said positioning panel is disposed.

16. The structure defined in claim 1, and a relatively rigid positioning panel disposed within the fold of at least one of said reverse folds of said layer, said positioning panel having a pair of opposite ends one of which is disposed adjacent one end of said layer and the other end of which extends into the crease of said fold within which said positioning panel is disposed, said latter end of said positioning panel being narrower than the opposite end thereof.

17. The structure defined in claim 1, wherein said layer of tissue panels has only two of said consecutive oppositely reversed folds and wherein one end of said layer extends beyond each of said folds to a position adjacent said centrally disposed opening whereby the tissue panel the end of which is closest to said centrally disposed opening may be readily removed from said layer and container without substantially disturbing the position of the remaining tissue panels within said container.

18. A flexible pocket facial tissue dispenser which may be diminished in size as tissues are dispensed therefrom in order to maintain the tissues remaining therewithin in proper alignment comprising:

(a) an elongated generally rectangular flexible container having longitudinally spaced opposed ends, opposed flexible sidewall members, flexible end walls, and a flexible bottom wall;

(b) said container having an opening between said ends and said sidewall members for the introduction of a layer of separate facial tissues superimposed one upon the other;

(c) a flexible closure member carried by said container for closing said container opening for thereby enclosing such a layer of tissues within said container;

(d) means for adjustably and releasably securing said flexible closure member over said opening in increasingly tightening closing relation to the interior of said container to thereby enable the user to progressively decrease the size of the interior of said container as the tissues are dispensed therefrom;

(e) one of said wall members having a centrally disposed opening extending therethrough and communicating with the interior of said container;

(f) a layer of a plurality of separate tissue panels superimposed upon one another, said layer being disposed within said container and being reversely folded longitudinally upon itself consecutively in opposite directions into substantially quarter sections;

(g) said layer having a pair of longitudinally spaced reversely folded end folds and an intermediate oppositely directed reverse fold disposed substantially midway between said end folds; and (h) said intermediate fold being disposed remotely relative to said centrally disposed opening of said container and said end folds being disposed more adjacent said centrally disposed opening whereby the outermost tissue panel of said layer may b readily removed from said container without substantially disturbing the position of the remainder of said tissue panels within said container.

19. The structure defined in claim 18, and expander means within said container and bearing against said folds for maintaining said layer in position as individual tissues are removed from said layer.

20. The structure defined in claim 18, wherein each of said tissues has a break side and said break side faces said centrally disposed opening.

21. The structure defined in claim 18, and at least one relatively rigid positioning panel disposed within the fold of one of said end folds and being surrounded thereby.

22. The structure defined in claim 21, wherein said positioning panel extends outwardly beyond the longitudinal extent of the fold in which it is disposed.

23. The structure defined in claim 21, wherein said positioning panel is more narrow adjacent the crease of the fold in which it is disposed than the areas thereof more remote from the crease of the fold.

24. The structure defined in claim 18, and a pair of relatively rigid positioning panels one each of which is disposed within the fold of one of said end folds and is surrounded thereby.

25. A pattern for a pocket facial tissue dispenser comprising:

(a) a panel of flexible material having a generally rectangular sidewall portion which has a pair of longitudinally spaced ends and opposite top and bottom areas;

(b) a pair of end flaps one of which extends outwardly from each of said end and being constructed and arranged to fold inwardly, one over the other, in overlapping relation over a layer of reversely folded separate facial tissues when such a layer is disposed upon said rectangular sidewall portion;

(c) means carried by said end flaps for securing each other in overlapping relation to each other and in retaining relation to such a layer;

(d) a flap carried by said panel by said sidewall portion at one of its sides and extending outwardly therefrom and being constructed and arranged to be swung around and over such a layer of reversely folded facial tissues to retain the same beneath said end flaps;

(e) a closure flap portion disposed opposite said flap and carried by said sidewall portion and being constructed and arranged to extend outwardly over such a layer of tissue in direct contact therewith and to be adjustably and releasably secured to said flap in over-lapping relation to said end flaps in increasingly tightening encasing relation to such a layer of folded facial tissues to form an adjustably sized dispenser of separate tissue therefrom; and (f) one of said portions having a centrally disposed opening formed therethrough through which tissues may be readily removed separately from such a layer of folded facial tissues when the layer is disposed beneath said end flaps, without substantially disturbing the position and orientation of the remainder of such tissues.

26. The structure defined in claim 25 wherein said opening is disposed within said sidewall portion.

27. The structure defined in claim 25 wherein said opening is disposed within said closure flap portion.

28. The structure defined in claim 25 wherein said opening is disposed within each of said portions.

29. The pattern defined in claim 25, and a layer of consecutively reversely folded facial tissues disposed between said sidewall portion and said end flaps and closure flap portion and confined thereby, said facial tissues having one entire end thereof adjacent said centrally disposed opening and the other end thereof removed therefrom.

30. A flexible pocket facial tissue dispenser which may be diminished in size as tissues are dispensed therefrom in order to maintain the tissues remaining therewithin in proper alignment comprising:

(a) a generally rectangular flexible container having a pair of opposed flexible end wall members, a pair of opposed flexible sidewall members, a flexible top wall member and a flexible bottom wall member;

(b) said container having an opening therein for the introduction of a layer of separate facial tissues superimposed one upon the other;

(c) a flexible closure member supported by one of said wall members for closing said opening in said container and thereby enclosing such tissues when disposed therewithin;

(d) means for adjustably and releasably securing said flexible closure member in increasingly tightening closing relation to said opening of said container to thereby enable the user to progressively decrease the size of the interior of said container as the tissues are dispensed therefrom;

(e) one of said sidewall members having an opening extending therethrough adjacent said top wall member and bringing the exterior into communication with the interior of said container therethrough;

(f) a layer of a plurality of separate tissue panels superimposed one upon another in non-interengaging relation, said layer being disposed within said container and being reversely folded at least twice longitudinally upon itself along transverse lines into consecutively oppositely directed reverse folds at least one of which constitutes an end fold;

(g) said end fold being disposed adjacent said sidewall opening and providing ready access to said tissue panels from the exterior;

(h) the reverse fold adjacent said end fold being disposed remotely relative to said sidewall opening; and (i) the tissue panel of said layer the end portion of which is disposed closest to said sidewall opening being the inside tissue of said remotely disposed reverse fold whereby said tissue panel, the end of which is closest to said sidewall opening, may be readily removed from said layer and said container without substantially disturbing the portion of the remaining tissue panels within said container.

31. The structure defined in claim 30, (j) a cover panel connected to said closure member and removably covering said sidewall opening; and (k) means for securing said cover panel in removable covering relation to said sidewall opening.

32. The structure defined in claim 30, wherein said sidewall opening extends into said top wall member.

33. The structure defined in claim 30, and (j) a positioning panel extending between said end fold and the fold immediately adjacent thereto.

34. The structure defined in claim 33, and (k) a retainer member carried by said positioning panel and bearing against said end fold.

35. The structure defined in claim 30, wherein said layer includes an end portion, an intermediate portion, and a third portion connected to said intermediate portion; (j) a pair of positioning panels connected to each other;

(k) one of said positioning panels extending between said end portion and said intermediate portion of said layer; and (l) the other of said positioning panels bearing against said third portion of said layer.

36. The structure defined in claim 35, and (m) a retainer member carried by at least one of said positioning panels and bearing against one of said layer portions to maintain same in proper orientation as a tissue is removed from said container.

37. A flexible pocket facial tissue dispenser comprising:

(a) a generally rectangular flexible container having a pair of opposed flexible end wall members, a pair of opposed flexible sidewall members, a flexible top wall member and a flexible bottom wall member;

(b) said container having an opening therein for the introduction of a layer of separate facial tissues superimposed one upon the other;

(c) a closure member supported by one of said wall members for cooperatively closing said container opening and thereby enclosing such tissues therewithin;

(d) means for securing said closure member in closing relation to the interior of said container;

(e) one of said wall members having a centrally disposed opening extending therethrough bringing the exterior into communication with the interior of said container therethrough;

(f) a layer of a plurality of separate tissue panels superimposed one upon another, said layer being disposed within said container and being reversely folded at least twice longitudinally upon itself into consecutively oppositely directed reverse folds at least one of which constitutes an end fold;

(g) said end fold being disposed adjacent said centrally disposed opening, thereby providing ready access to said tissue panels from the exterior;

(h) one of said reverse folds being disposed remotely relative to said centrally disposed opening;

(i) the tissue panel the end portion of which is closest to said centrally disposed opening being the inside tissue of said remotely disposed reverse fold whereby said tissue panel the end of which is closest to said centrally disposed opening may be readily removed from said layer and said container without substantially disturbing the position of the remaining tissue panels within said container; and (h) a substantial area of said cooperating wall member in which said centrally disposed opening is formed remaining between said centrally disposed opening and each of said end walls whereby the remaining panel tissues are held in place thereby within the dispenser as the tissue panel, the end of which is closest to said centrally disposed opening, is withdrawn.

38. A flexible pocket facial tissue dispenser comprising:

(a) a generally rectangular flexible container having a pair of opposed flexible end wall members, a pair of opposed flexible sidewall members, a flexible top wall member, and a flexible bottom wall member;

(b) said container having an opening therein for the introduction of a layer of separate facial tissues superimposed one upon the other;

(c) a closure member supported by one of said wall members for cooperatively closing said container opening and thereby enclosing such tissues therewithin;

(d) means for securing said closure member in closing relation to the interior of said container;

(e) one of said wall members having a centrally disposed opening extending therethrough bringing the exterior into communication with the interior of said container therethrough;

(f) a layer of a plurality of separate tissue panels superimposed one upon another, said layer being disposed within said container and being reversely folded at least twice longitudinally upon itself into consecutively oppositely directed reverse folds at least one of which constitutes an end fold;

(g) said end fold being disposed adjacent said centrally disposed opening, thereby providing ready access to said tissue panels from the exterior;

(h) one of said reverse folds being disposed remotely relative to said centrally disposed opening;

(i) the tissue panel the end portion of which is closest to said centrally disposed opening being the inside tissue of said remotely disposed reverse fold whereby said tissue panel the end of which is closest to said centrally disposed opening may b readily removed from said layer and said container without substantially disturbing the position of the remaining tissue panels within said container; and (j) a relatively rigid positioning panel disposed within the fold of at least one of said reverse folds of said layer, said positioning layer having a pair of opposite ends of of which is disposed adjacent one end of said layer and the other end of which extends into the crease of said fold within which said positioning panel is disposed, said latter end of said positioning panel being narrower than the opposite end thereof.

39. A pattern for a pocket facial tissue dispenser comprising:

(a) a panel of flexible material having a generally rectangular sidewall portion which has a pair of longitudinally spaced ends and opposite top and bottom areas;

(b) a pair of end flaps one of which extends outwardly from each of said ends and being constructed and arranged to fold inwardly, one over the other, in overlapping relation over a layer of reversely folded separate facial tissues when such a layer is disposed upon said rectangular sidewall portion;

(c) means carried by said end flaps for securing each other in overlapping relation to each other and in retaining relation to such a layer;

(d) a flap carried by said panel by said sidewall portion portion at one of its sides and extending outwardly therefrom and being constructed and arranged to be swung around and over such a layer of reversely folded facial tissues to retain the same beneath said end flaps;

(e) a closure flap portion disposed opposite carried by said sidewall portion and being constructed and arranged to extend outwardly over such a layer of tissue in direct contact therewith and to be secured to said flap in over-lapping relation to said end flaps in a plurality of positions and in encasing relation to such a layer of folded facial tissues to form an adjustably sized dispenser of separate tissue therefrom; and (f) one of said portions having a centrally disposed opening formed therethrough through which tissues may be readily removed separately from such a layer of folded facial tissues when the layer is disposed beneath said end flaps, without substantially disturbing the position and orientation of the remainder of such tissues.

40. The structure defined in claim 39, wherein said opening is disposed within said sidewall portion.

41. The structure defined in claim 39, wherein said opening is disposed within said closure flap portion.

42. The structure defined in claim 39, wherein said opening is disposed within each of said portions.

43. The pattern defined in claim 39, and a layer of consecutively reversely folded facial tissues disposed between said sidewall portion and said end flaps and closure flap portion and confined thereby, said facial tissues having one entire end thereof adjacent said centrally disposed opening and the other end thereof removed therefrom.

44. A flexible pocket facial tissue dispenser comprising:

(a) a generally rectangular flexible container having a pair of opposed flexible end wall members, a pair of opposed flexible sidewall members, a flexible top wall members and a flexible bottom wall member;

(b) said container having an opening therein for the introduction of a layer of separate facial tissues superimposed one upon the other;

(c) a closure member supported by one of said wall members for closing said opening in said container and thereby enclosing such tissues when disposed therewithin;

(d) means for adjustably securing said closure member in closing relation to said opening of said container;

(e) one of said sidewall members having an opening extending therethrough adjacent said top wall member and bringing the exterior into communication with the interior of said container therethrough;

(f) a layer of a plurality of separate tissue panels superimposed one upon another in non-interengaging relation, said layer being disposed within said container and being reversely folded at least twice longitudinally upon itself along transverse lines into consecutively oppositely directed reverse folds at least one of which constitutes an end fold;

(g) said end fold being disposed adjacent said sidewall opening and providing ready access to said tissue panels from the exterior;

(h) the reverse fold adjacent said end fold being disposed remotely relative to said sidewall opening;

(i) the tissue panel of said layer the end portion of which is disposed closest to said sidewall opening being the inside tissue of said remotely disposed reverse fold whereby said tissue panel, the end of which is closest to said sidewall opening, may be readily removed from said layer and said container without substantially disturbing the position of the remaining tissue panels within said container;

(j) a positioning panel extending between said end fold and the fold immediately adjacent thereto; and (k) a retainer member carried by said positioning panel and bearing against said end fold.

45. A flexible pocket facial tissue dispenser comprising:

(a) a generally rectangular flexible container having a pair of opposed flexible end wall members, a pair of opposed flexible sidewall members, a flexible top wall member and a flexible bottom wall member;

(b) said container having an opening therein for the introduction of a layer of separate facial tissues superimposed one upon the other;

(c) a closure member supported by one of said wall members for closing said opening in said container and thereby enclosing such tissues when disposed therewithin;

(d) means for adjustably securing said closure member in closing relation to said opening of said container;

(e) one of said sidewall members having an opening extending therethrough adjacent said top wall member and bringing the exterior into communication with the interior of said container therethrough;

(f) a layer of a plurality of separate tissue panels superimposed one upon another in non-interengaging relation, said layer being disposed within said container and being reversely folded at least twice longitudinally upon itself along transverse lines into consecutively oppositely directed reverse folds at least one of which constitutes an end fold;

(g) said end fold being disposed adjacent said sidewall opening and providing ready access to said tissue panels from the exterior;

(h) the reverse fold adjacent said end fold being disposed remotely relative to said sidewall opening;

(i) the tissue panel of said layer the end portion of which is disposed closest to said sidewall opening being the inside tissue of said remotely disposed reverse fold whereby said tissue panel, the end of which is closest to said sidewall opening, may be readily removed from said layer and said container without substantially disturbing the position of the remaining tissue panels within said container;

(j) said layer including an end portion, an intermediate portion, and a third portion connected to said intermediate portion;

(k) a pair of positioning panels connected to each other;

(l) one of said positioning panels extending between said end portion and said intermediate portion of said layer;

(m) the other of said positioning panels bearing against said third portion of said layer; and (n) a retainer member carried by at least one of said positioning panels and bearing against one of said layer portions to maintain same in proper orientation as a tissue is removed from said container.

* * * * *

UNITED STATES PATENT AND TRADEMARK OFFICE

CERTIFICATE OF CORRECTION

PATENT NO. : 5,076,465

DATED : December 31, 1991

INVENTOR(S) : Lawson

It is certified that error appears in the above-identified patent and that said Letters Patent is hereby corrected as shown below:

Column 2, line 52, change "performed" to --preformed--.

Column 2, line 61, change "performed" to --preformed--.

Column 4, line 35, after "opening" change "1" to --31--.

Column 4, line 57, change "6" to --36--.

Column 5, line 64, change "Then" to --When--.

Column 6, line 35, change "5" to --51--.

Column 6, line 46, change "must" to --much--.

Column 9, line 20, change "readily" to --ready--.

Column 9, line 24, after "portion" change "o" to --of--.

Column 9, line 57, after "sidewall" change "member" to --members--.

Column 12, line 62, change "portion" to --position--.

Column 14, line 37, after "may" change "b" to --be--.

UNITED STATES PATENT AND TRADEMARK OFFICE

CERTIFICATE OF CORRECTION

PATENT NO. : 5,076,465

DATED : December 31, 1991

INVENTOR(S) : Lawson

It is certified that error appears in the above-identified patent and that said Letters Patent is hereby corrected as shown below:

Column 14, line 44, cancel "of of" and insert therefor --one of--.

Column 15, line 3, after "opposite" insert --said flap and--.

Signed and Sealed this

Twenty-fifth Day of May, 1993

*Attest:*

Michael K. Kirk

MICHAEL K. KIRK

*Attesting Officer*

*Acting Commissioner of Patents and Trademarks*